United States Patent [19]

McMurray

[11] 3,977,497

[45] Aug. 31, 1976

[54] HYDRAULIC ELEVATOR DRIVE SYSTEM

[75] Inventor: David Claude McMurray, Whitefish Bay, Wis.

[73] Assignee: Armor Elevator Company, Inc., Louisville, Ky.

[22] Filed: Feb. 26, 1975

[21] Appl. No.: 553,442

[52] U.S. Cl. ..... 187/29 A; 187/17
[51] Int. Cl.[2] ..... B66B 1/04
[58] Field of Search ..... 187/17, 28, 29

[56] References Cited

UNITED STATES PATENTS

| | | | |
|---|---|---|---|
| 2,726,735 | 12/1955 | Rohrberg | 187/29 |
| 3,187,844 | 6/1965 | MacNair et al. | 187/29 |
| 3,570,243 | 3/1971 | Comer et al. | 187/28 X |

*Primary Examiner*—Robert K. Schaefer
*Assistant Examiner*—W. E. Duncanson, Jr.
*Attorney, Agent, or Firm*—Andrus, Sceales, Starke & Sawall

[57] ABSTRACT

A hydraulic elevator drive system utilizes an elevator car speed signal and a commanded velocity signal to provide an electrical error signal and controls the operation of a fluid control regulating the fluid flow between a hydraulic actuator which moves the car, a hydraulic pump and a fluid reservoir. The fluid control includes a combined check and lowering valve and a by-pass valve selectively operated by a common control element including a dynamically operated control piston responding to the error signal. Another check valve couples the fluid pump to the fluid control whle a pair of manually preset control valve regulate the supply of fluid to the control piston for providing preestablished acceleration limitations to the elevator car.

32 Claims, 2 Drawing Figures

HYDRAULIC ELEVATOR DRIVE SYSTEM

BACKGROUND OF THE INVENTION

This invention relates to a hydraulic elevator drive system wherein fluid control means regulates the fluid within a hydraulic actuator operatively controlling the movement of an elevator car.

Hydraulic elevator systems have commonly employed one or more valves for controlling the supply of fluid to and from a hydraulic actuator such as a jack or the like to thereby control movement of an elevator car for transporting load, such as passengers, for example, between a plurality of landings within a building structure. Such valving structure has been selectively operated in conjunction with a hydraulic pump for selectively supplying fluid under pressure to the hydraulic jack for raising the elevator car. Likewise, valving structure has been selectively controlled to vent the control fluid from the hydraulic jack for permitting the car to descend.

The use of an integrated valve structure containing a plurality of control valves has been found to be highly desirable for interconnecting a fluid pump, a fluid reservoir and the actuating jack to control both upward and downward movements of an elevator car. One desirable system is shown in the U.S. Pat. No. 3,508,468, issued on Apr. 28, 1970 and assigned to a common assignee herewith, which employs a by-pass valve functioning with a check valve for selectively controlling the flow of fluid from a pump to an actuating jack or cylinder while a bleed valve interconnects the actuating jack or cylinder with a reservoir for controlling downward movement of the car.

Another known system employs a first valve and valve operator to interconnect a fluid pump with an actuating jack which functions as a combined check and lowering valve while a second valve and associated valve operator interconnects the pump with a reservoir, such as shown in the U.S. Pat. No. 2,737,197, issued on Mar. 6, 1956. The control apparatus in the U.S. Pat. No. 2,737,197 provides variable upward control by varying the opening of the by-pass valve and variable downward control by varying the check and lowering valve.

Some known systems have regulated the positioning of a lift platform or the like by generating an electrical position responsive signal which is compared with a commanded positioned signal for generating a position error control signal, such as shown in the U.S. Pat. No. 3,570,243, issued on Mar. 16, 1971, which controls a hydraulic pump motor operation to vary the fluid flow to the hydraulic lift actuator.

The speed of a lift or elevator has been controlled by regulating the amount of fluid flow to or from a hydraulic actuator or jack through the selective positioning of one or more valves. One known system selectively positions and regulates the movement of a deck edge elevator on the side of a ship, such as shown in the U.S. Pat. No. 2,409,198, issued on Oct. 15, 1946, by selectively positioning a control valve in response to a mechanical differential responsive to the speed of an operating plunger and to the speed of an electric motor.

SUMMARY OF THE INVENTION

This invention relates to a hydraulic elevator drive system wherein fluid control means regulates the fluid within a hydraulic actuator operably controlling the movement of an elevator car.

One aspect of the invention is directed to the generation of an electrical speed error signal for operatively controlling the passage of fluid from the hydraulic actuator and controlling the downward movement of an elevator car in a highly regulated manner. In such construction and operation, an electrical speed command signal is compared with an electrical velocity signal responsive to the speed of the elevator car. The employment of an electrical speed error signal provides a highly regulated and desirable control which includes responding means operable to a first condition permitting fluid to be maintained by the hydraulic actuator and a second condition permitting the venting of fluid from the hydraulic actuator. The responding means desirably varies the venting of fluid flow from the hydraulic actuator in response to the varying electrical speed error signal for providing continuous and accurate speed control upon a downwardly traveling car. The responding means also functions with the electrical speed error signal and provides an acceleration limitation upon the downwardly traveling car.

The invention also includes a highly desirable construction for controlling the fluid flow between a fluid pump and the hydraulic actuator in response to an electrical speed error signal such as provided by the comparison of an electrical speed command signal and an electrical velocity signal varying according to the speed of the car when traveling in an upward direction. The electrical speed error signal operatively controls the responding means and provides a first condition permitting fluid to be maintained by the hydraulic actuator and a second condition permitting fluid flow from the pump to the hydraulic actuator. The responding means also provides means for operatively varying the fluid flow from the pump to the hydraulic actuator in response to a varying electrical speed error signal. Such responding means also includes means functioning with the speed error signal and provides an acceleration limitation upon the car.

The responding means also functions with the speed error signal in a highly desirable manner to provide a third condition for venting fluid from the hydraulic actuator and moving the car in a downward direction.

The fluid control means regulating the fluid within the hydraulic actuator provides a highly novel first and second valve means which are selectively operable by a control member having a first position operatively maintaining fluid within the hydraulic actuator and a second position operatively venting fluid from the hydraulic actuator by the simultaneous opening of the first and second valve means.

In a highly desirable construction, a fluid pressure control chamber provides a first control force upon the control member which, in turn, also experiences a second control force. The fluid pressure within the pressure chamber is selectively controlled for positioning the control member between the first and second positions and the selective opening of the first and second valve means. The pressure controlling means utilizes selectively operable vent means for regulating fluid pressure within the pressure chamber. In a highly desirable operation, the venting of fluid from the pressure chamber is selectively varied in response to an error signal derived in response to a movement command signal and a car operational responsive signal.

In a preferred form of the invention, a pair of pressure chambers are utilized to provide the first and second control forces to selectively position the control member. The employment of a pair of pressure control chambers provides a highly desirable uniform control for effecting both upward and downward movement and for maintaining the car in a stopped position. With such construction, the control member can also assume a third position permitting fluid flow from the pump to the hydraulic actuator. The pressure controlling means provides vent means which vents fluid from the first pressure chamber for establishing the second position for downward elevator travel and also vents fluid from the second pressure chamber for establishing the third position for upward car movement.

The variable venting of the pair of pressure chambers thus operatively controls the movement of the control member in response to the error signal derived from a movement command signal and an operational responsive signal for establishing a highly desirable closed loop control in both the up and down directions of travel. The pair of pressure chambers may also be selectively vented with car travel in a first direction to provide accurate speed control as dictated by the command signal.

A highly desirable acceleration limitation control operates in conjunction with the pressure chamber and the operation of the control member. Such acceleration limitation control includes means which selectively varies the rate of fluid flow to the pressure chamber thereby limiting the rate of response of the control member and the movement of the elevator car. In a preferred construction, independently adjustable first and second valves interconnect a fluid source to the pressure control chambers for independently establishing first and second preselected acceleration limitations for the up and down directions, respectively.

The utilization of first and second valve means selectively operable by a control member provides a highly desirable up and down control because the control member can assume a first position to operatively maintain fluid within the hydraulic actuator, a second position for operatively venting fluid from the hydraulic actuator by the simultaneous opening of the first and second valve means, and a third position permitting fluid flow from a pump to the hydraulic actuator. The first position provided by the control member can operatively function with the actuation of the pump so that pumped fluid supplied to the fluid control means is operatively vented therefrom and the elevator car is maintained in a stationary condition. Such sequence of operation avoids the transient conditions otherwise frequently experienced upon initiation of pump actuation thereby providing greater riding comfort to passengers.

In a preferred embodiment of the invention, the fluid control means includes a control structure providing a chamber having a first port operatively connected to the hydraulic actuator, a second port operatively connected to the pump, and a third port operatively connected to vent fluid such as to a storage tank, for example. A first normally closed valve is positioned within the second port and operates in response to the operation of the fluid pump to permit fluid entry into the chamber. A second valve is positioned with the first port which is normally biased to a closed condition and is selectively operated in response to an increase of pressure within the chamber to permit fluid flow to the hydraulic actuator. A third valve is positioned within the third port and is selectively operable between open and closed positions for regulating the venting of fluid from the chamber.

A valve operator selectively operates the second and third valves between open and closed positions and includes a piston connected through a valve stem to the third valve. First and second piston chamber portions are spaced on opposite sides of the piston and are supplied fluid under pressure such as through a conduit connected to the output of the first port. The valve stem of the valve operator includes a control chamber having a first control port communicating with the first chamber portion and a second control port communicating with the second chamber portion while a third control port communicates with the vent provided by the third port. A control element is movably disposed within the control chamber and includes a control channel having a first end operatively communicating with the vent at the third port and a second end selectively communicating with the first and second control ports.

In operation, the control element assumes a first position to close the first and second control ports for maintaining the valve stem at a first position which operatively opens the third valve and permits the second valve to close and hold the car at stationary condition. The valve element is selectively moved to a second position and closes the first control port and communicates the second control port with the second end of the control channel for operatively moving the valve stem to a second position to close the third valve so that the operation of the pump will open the first and second valves to move the car in an upward direction. The control element is selectively moved to a third position and closes the second control port and communicates the third control port with the second end of the control channel for operatively moving the valve stem to a third position to open the second and third valves to move the car in a downward direction.

The control element is desirably positioned by a motor operated cam to provide a variable control which is capable of continually varying the movement of the valve operator. Such variable control is provided by the electrically controlled positioning of the cam output in response to an electrical speed error signal responsive to a speed command signal and a sensed car speed signal for providing continuous and desirable speed control of the hydraulic system.

The invention thus provides a highly desirable electrical and hydraulic control to selectively move an elevator car with riding comfort to passengers and efficient service by the desirable regulation of speed control and the limitations upon acceleration. Such objectives are readily accomplished through the provision of a highly responsive fluid valving structure which may be readily constructed for compact installation.

BRIEF DESCRIPTION OF THE DRAWINGS

The drawings furnished herewith illustrate the best mode presently contemplated by the inventor and clearly discloses the above advantages and features as well as others which will be readily understood from the detailed description thereof.

In the drawings.

DESCRIPTION OF THE PREFERRED ILLUSTRATED EMBODIMENT

Figure 1:
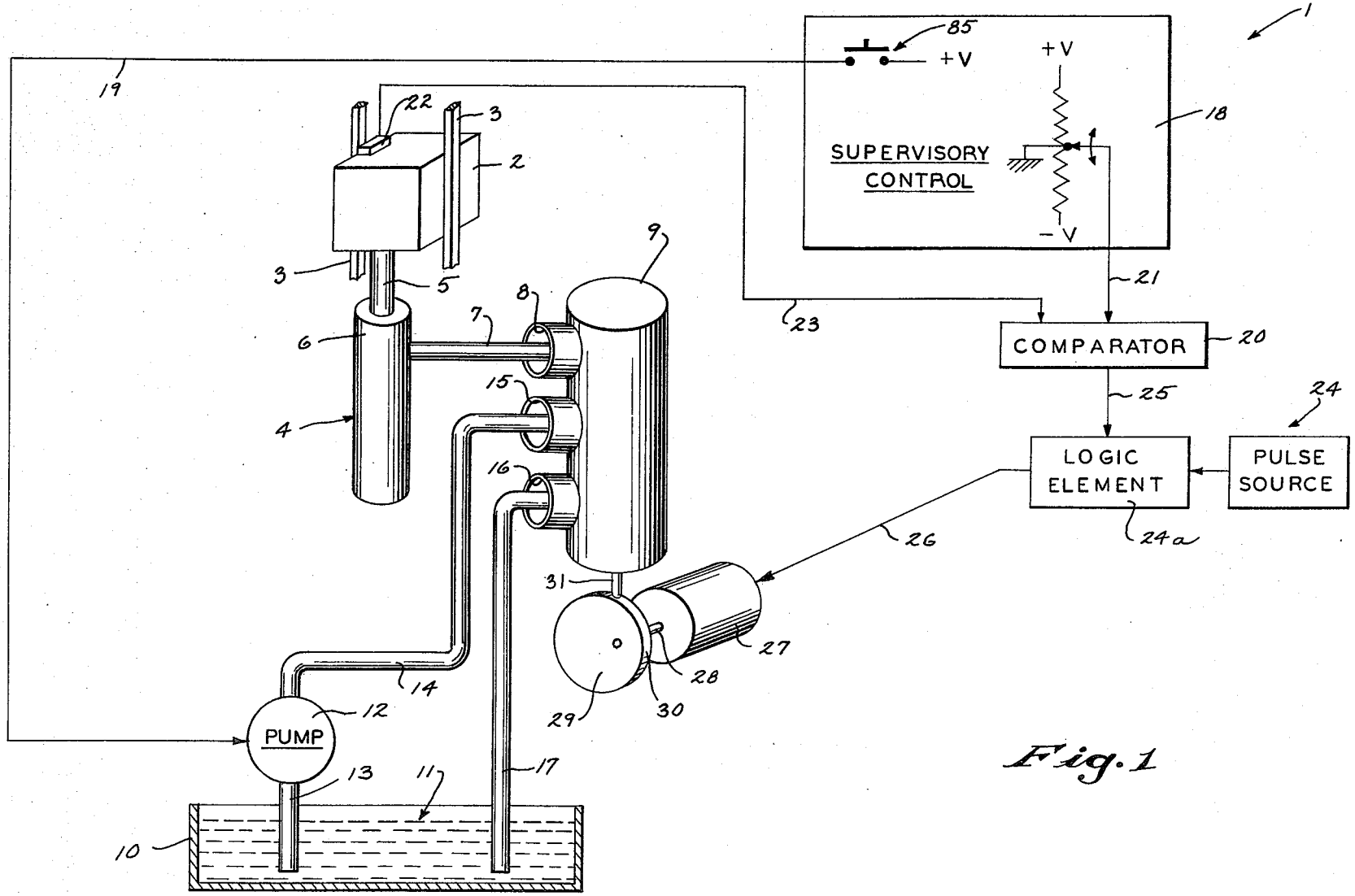
FIG. 1 is a diagrammatic view of a hydraulic elevator system illustrating an electrical control in block diagrammatic form operating a hydraulic control for controlling the movement of an elevator car.

FIG. 1 illustrates a hydraulic elevator drive system 1 wherein an elevator car 2 is movably mounted to a plurality of guide rails 3 for transporting a load between a plurality of landings in a building structure (not shown). The car 2 is provided with one or more access openings in which selectively operable doors are mounted for permitting load transfer at a selected landing which is well known and understood in the art and further detailed description thereof is deemed unnecessary to a full and clear understanding of the invention.

The car 2 is mounted upon a hydraulic actuator or jack 4 including a plunger 5 mounted for vertical reciprocating movement within a cylinder 6. A conduit 7 bi-directionally conducts a hydraulic actuating fluid between the cylinder 6 and a port 8 provided by a fluid control 9. A reservoir or storage tank 10 contains hydraulic actuating fluid 11 consisting of oil or any other appropriate hydraulic fluid. While reservoir 10 is shown holding the hydraulic fluid 11 under atmospheric conditions, it is understood that fluid 11 could be stored in a closed container and maintained under pre-established conditions concerning pressure and temperature for appropriate operation. A hydraulic pump 12 may be of a constant displacement type and is connected to the hydraulic fluid 11 within reservoir 10 through a conduit 13. Pump 12 is also connected through a conduit 14 for supplying hydraulic fluid to a port 15 within the fluid control 9. A port 16, also within the fluid control 9, is connected to the reservoir 10 through a conduit 17.

A supervisory control 18 is connected through an electrical lead 19 to selectively operate pump 12 to supply hydraulic fluid to the port 15. The supervisory control 18 also selectively provides an electrical speed command signal which is supplied to a comparitor circuit 20 through an electrical lead 21. The commanded or desired speed signal at lead 21 is summated and/or compared within comparitor 20 with an electrical speed signal supplied from a tachometer 22 associated with the elevator car 2 through a lead 23. The tachometer 22 is selected from any one of well known commercial analog or digital velocity sensing apparatus which is capable of supplying a velocity dependent signal to the comparitor 20. The comparitor 20, in turn, functions to provide a speed error signal to a control and regulating circuit 24 through an electrical lead 25. The control and regulating circuit 24, in turn, operates in response to the speed error signal and supplies a motor operating control signal through a lead 26 to control the operation of an electrical motor 27. An output shaft 28 of motor 27 is connected to an eccentric cam 29 having an outer control surface 30 which slidably engages a movable control element 31 provided by the fluid control 9. The motive unit 27 is shown operating as a stepper motor while the control and regulating circuit 24 responds to the speed error signal and supplies controlled stepper pulses of a preselected polarity. A logic element 24a may constitute a forward logic circuit and a reverse logic circuit which selectively respond to the error signal at lead 25 to supply forward and reverse direction control pulses to the motor 27. The cam element 29 thus selectively rotates in either a forward or reverse direction by prescribed amounts as dictated by the speed error signal appearing on the lead 25.

Figure 2:
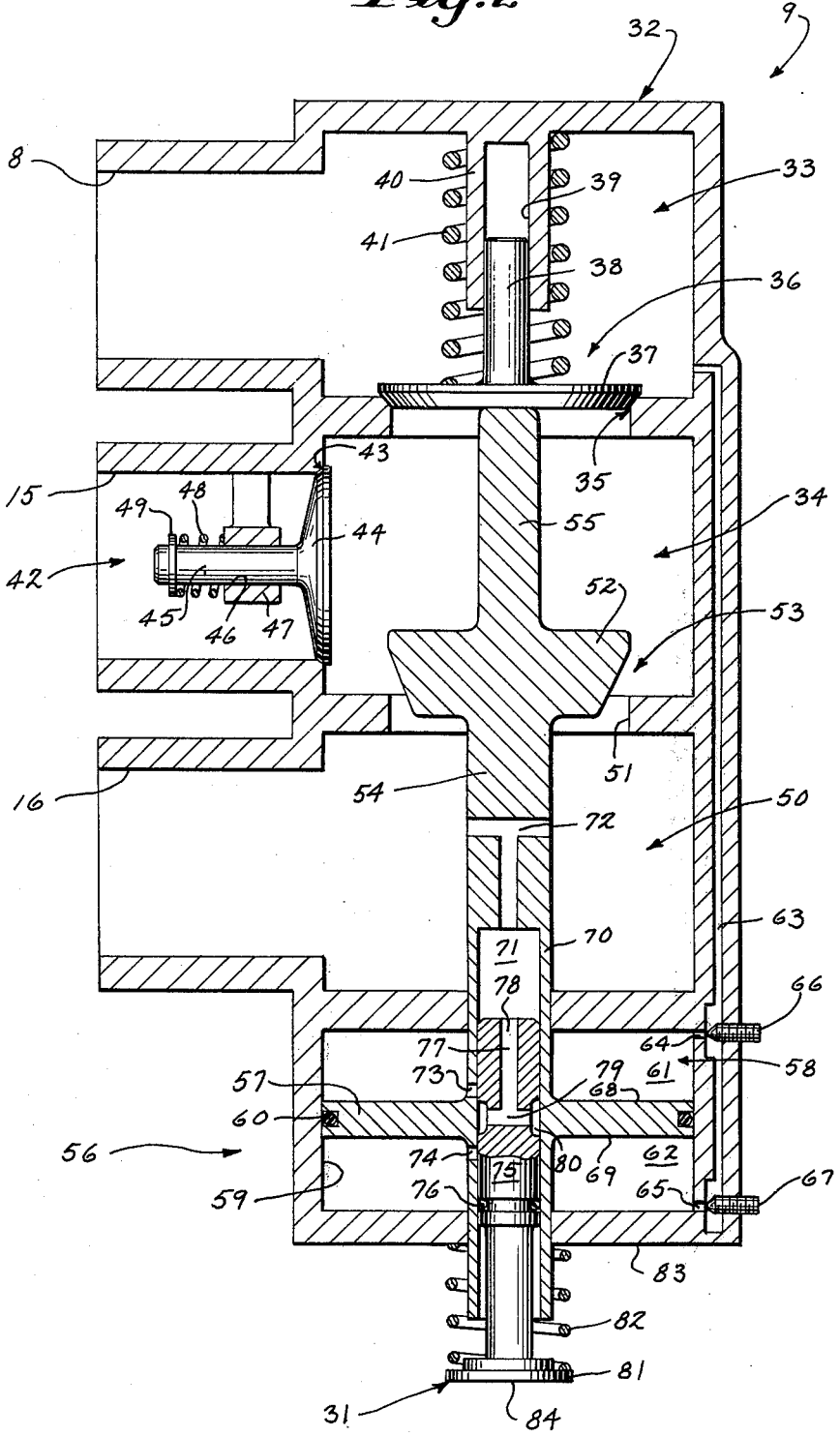
FIG. 2 is a front sectionalized view of a portion of the hydraulic control of FIG. 1.

The fluid control 9 is more fully shown in FIG. 2 and includes a valve body 32 which is illustrated as a unitary structure but which may optionally be constructed of separate parts which are fixedly interconnected to form the body structure 32.

The structure 32 includes an upper cavity or chamber 33 which freely communicates with port 8 and an intermediate cavity or chamber 34 which communicates with the upper chamber 33 through a valve seat 35. A poppet type check valve 36 is mounted for vertical movement within the upper chamber 33 and includes a valve head 37 formed to selectively seal with valve seat 35 and includes a valve stem 38 which is slidably disposed within an annular opening 39 provided by a protruding annular guide flange 40 protruding from the upper portion of the chamber 33. A biasing spring 41 surrounds the annular guide protrusion 40 and interconnects the wall of chamber 33 with the valve head 37 for biasing the check valve 36 toward a normally closed condition to seal the valve head 37 with seat 35.

The intermediate chamber 34 also communicates with the port 15 through a poppet type check valve 42 which operates to selectively seal a valve seat 43 located within the port 15. The check valve 42 includes a valve head 44 and an annular valve stem 45 which is movably mounted within an annular opening 46 provided by a guide projection 47 protruding from the wall of port 15. A biasing spring 48 is connected to an annular stop 49 connected to an outer end of the valve stem 45 and is further connected to the guide projection 47. The spring 48 operates to bias the valve head 44 to a normally closed condition to seal with the valve seat 43 for closing the port 15.

A lower chamber 50 is interconnected with the intermediate chamber 34 through a valve seat 51. The lower chamber 50 also communicates with the port 16. A vertically movable valve head 52 operates to selectively seal with the valve seat 51 to provide a by-pass valve 53. The valve head 52 is fixedly connected to a valve stem 54 and to an outer stem projection 55 and is selectively operated by a valve operator 56. A piston 57 of the valve operator 56 is fixedly connected to the valve stem 54 and is positioned within a piston chamber 58. The piston 57 is annularly formed to movably engage the annular side walls 59 while an O-ring seal 60 prevents fluid leakage between an upper chamber portion 61 and a lower chamber portion 62.

Hydraulic fluid within the upper chamber 33 is supplied through a channel 63 formed within the wall of the body structure 32 to the upper chamber portion 61 through an inlet passageway 64 and also to the lower chamber portion 62 through an inlet passageway 65. Fluid flow through the passageway 64 and 65 is varied and controlled by the selective adjustment of a pair of needle valves 66 and 67, respectively. In operation, the accumulated pressure within the upper chamber 61 operates upon an upper surface 68 of the piston 57 while the fluid pressure within the lower chamber 62 operates upon a lower surface 69.

A portion 70 of the valve stem 54 contains an annular control chamber 71 which is connected to communicate with the lower chamber 50 through a T-shaped control port 72 and further communicates with the upper chamber portion 61 through a control port 73 and with the lower chamber portion 62 through a control port 74.

The control element 31 includes an annular control stem 75 which is slidably movable within the control chamber 71 and carries an O-ring seal 76 for preventing fluid leakage between the control chamber 71 and the exterior of the fluid control 9. The stem 75 of the control element 31 contains a control channel 77 having an outer end 78 communicating with the control chamber 71 and a T-shaped outer end 79 communicating with an annular recess 80 formed between the control stem 75 and the wall of the control chamber 71. An outer flange 81 is connected to the stem 75 and mounts a biasing spring 82 which, in turn, is connected to a lower surface 83 of the body structure 32. The outer flange 81 also provides a cam following surface 84 which engages the cam surface 30 of cam 29 as illustrated in FIG. 1.

The shown position of the elements in FIG. 2 illustrates a condition where elevator car 2 is stationary such as at a landing for permitting passenger transfer. The hydraulic fluid within the cylinder 6 which supports the car 2 communicates with the upper chamber 33 through the port 8 and conduit 7 and functions with the biasing spring 41 to close the poppet valve 36 with valve head 37 engaging valve seat 35. The closure of check valve 36 maintains the hydraulic fluid within cylinder 6 and holds car 2 at a stationary postion.

The registration of demand for service for the elevator is sensed by the supervisory control 18 to control the movement of car 2. As an example, the registration of a hall call or of a car call by a passenger entering into the car 2 and requiring upward movement initiates a door closure and further supplies a pump start-up signal to lead 19 by closing a switch 85. Hydraulic fluid from reservoir 10 is thereafter supplied by pump 12 to the port 15 through conduits 13 and 14. The increase of pressure occurring at port 15 because of the pump operation opens at poppet valve 42 permitting hydraulic fluid to flow into the intermediate chamber 34. The valve 53, however, is maintained at an opened position as shown so that fluid is vented through the chamber 50 and port 16 to be returned to the reservoir 10.

Upward movement is established by supervisory control 18 when a speed command signal is supplied at lead 21 having a first polarity and a pre-determined magnitude for commanding a pre-determined velocity for the elevator car 2. Because car 2 is initially stationary, a zero magnitude velocity signal exists on lead 23 so that the error signal on lead 25 is dominated by the command signal on lead 21. Such a substantial error signal operates the stepper motor to rotate the cam surface 30 in a counter-clockwise direction to allow the control element 31 to vertically descend by the operation of the biasing spring 82. On the other hand, the command signal on lead 21 can be varied by predetermined increments or in response to a continuous electrical signal pattern thereby gradually operating the stepper motor 27 by the continuously varying error signal.

The descent of stem 75 of the control element 31 permits the annular opening 80 to communicate with the control port 74 and vent the fluid within the lower chamber portion 62 to the lower chamber 50 through the control port 74, annular chamber 80, control channel 77, control chamber 71 and the control port 72. The descending control stem 75 also maintains the control port 73 closed. As a result, the descent of control element 31 effectively decreases the pressure or force exerted against the piston side 69 so that piston 57 becomes unbalanced and is forced to move downwardly carrying the valve stem 54 and the by-pass valve head 52 with it. The amount of downward movement of control element 31 establishes the rate of fluid venting from chamber portion 62 by varying the size of the communicating opening between control port 74 and annular chamber 80.

The downward movement of the control element 31 thus regulates and controls the downward movement of piston 57 which effectively operates as a force multiplier to vary the closure of the by-pass valve 53. Because of the substantial error signal and the operation of the pump 12, the by-pass valve is initially substantially closed so that fluid entering through poppet valve 42 increases the pressure within intermediate chamber 34 and opens poppet valve 36 so that hydraulic fluid is supplied to the hydraulic actuator 4 to move the car 2 in an upward direction. The maximum velocity attainable by car 2 when traveling in an upward direction is established by the selective positioning of the by-pass valve 53, the pumping capabilities of pump 12, and the physical limitations of the system.

The fluid control 9 provides a highly desirable feature when the system is conditioned to initiate operation in an upward direction by permitting fluid flow from the pump 12 to the reservoir 10 for a short period of time before the by-pass valve 53 starts to close. Such a sequence allows the fluid pump 12 to operate to capacity before being required to direct fluid to the hydraulic actuator 4 which reduces the transient conditions which may otherwise be subjected upon the pump 12.

As car 2 travels upwardly at an increasing speed, a speed signal is supplied from tachometer 22 to the comparitor 20 and reduces the error signal at lead 25. As the error varies, the cam surface 30 is selectively rotated in a clockwise direction to gradually raise the control element 31. The corresponding upward movement of control stem 75 gradually decreases the opening between control port 74 and annular chamber 80 so that the pressure within chamber portion 62 gradually increases while control port 73 remains closed. The increase of pressure within chamber portion 62 thus operatively moves piston 57 upwardly in a gradual manner to gradually open the by-pass valve 53.

The regulated opening of the by-pass valve 53 varies the pressure of the fluid within chamber 34 and regulates the opening of poppet valve 36 and the fluid flow therethrough. As the car speed reaches the desired speed of the command signal, a zero or null error signal will appear at lead 25 which effectively positions the cam surface 30 to correspondingly position the control element 31 substantially as shown in FIG. 2 whereby both control ports 73 and 74 are closed by the control stem 75. In such a condition, the by-pass valve 53 is held in a partially opened position to regulate the pressure within the intermediate chamber 34 to maintain the check valve 36 at a proper open position to maintain the commanded velocity for the car 2 as dictated by the command signal at lead 21.

Should the car speed when traveling in an upward direction exceed the commanded speed, the output of comparitor 20 provides an error signal which rotates the cam surface 30 in a counter-clockwise direction to correspondingly raise the control element 31. The control stem 75 correspondingly rises to communicate the control port 73 with the annular chamber 80 to vent fluid from the chamber portion 61 to the lower chamber 50 through the control channel 77. The resulting decreased pressure within chamber portion 61 causes piston 57 to rise thereby increasing the opening within the by-pass valve 53 to correspondingly decrease the pressure within intermediate chamber 34. Thus greater quantities of fluid are by-passed by the valve 53 to decrease the upward speed inparted to car 2.

It is therefore evident that the closed loop control provided by the drive system 1 continually monitors the operation of the elevator car 2 to maintain an exacting control which is self-regulating in accordance with the commanded velocity provided by the supervisory control 18.

When it is desired to stop the car 2, the velocity command signal at lead 21 is decreased to a zero magnitude thus dictating zero velocity so that the speed error signal at lead 25 is dominated by the speed signal at lead 23. Such a large error signal rotates the cam surface 30 in the appropriate direction to open the by-pass valve 53 while the switch 85 opens to de-activate the pump motor 12. The poppet valve 42 thus closes with pump 12 de-activated to seal the port 15 while the opened by-pass valve 53 creates s substantial pressure drop within intermediate chamber 34 so that the check valve 36 rapidly closes and maintains car 2 in a stationary position. The stopping of car 2 thus results in a zero speed signal at lead 23 so that the error signal at 25 decreases to zero at which point the cam surface 30 positions the control element 31 substantially as shown in FIG. 2.

When service demand required that the elevator car 2 travel in a downward direction, the supervisory control maintains switch 85 open and thus likewise maintains pump 12 de-activated so that poppet valve 42 remains closed to seal port 15. Downward movement is initiated by a velocity command signal being supplied to the comparitor 20 through lead 21, which, when compared with a zero speed signal on lead 23, provides a substantial error signal on lead 25 to rotate the cam surface 30 in a clockwise direction to correspondingly raise the control element 31.

Because of the developed error signal, the rotation of cam surface 30 raises control element 31 and communicates the control port 73 with the annular chamber 80. Fluid is thus vented from the chamber portion 61 to the lower chamber 50 through the control channel 77, the control chamber 71 and the control port 72. The pressure within chamber portion 61 rapidly decreases to correspondingly permit rapid upward movement of piston 57. The valve stem 54 and the upper stem portion 55 correspondingly rapdily raise so that the upper stem portion 55 engages the valve head 37 and physically opens the poppet valve 36 to a substantially open position. The upward movement of the valve stem 54 also opens the by-pass valve 53 so that fluid drains from the hydraulic actuator 4 to the reservoir 10 through the conduit 7, port 8, upper chamber 33, intermediate chamber 34, lower chamber 50, port 16 and conduit 17.

As the downward traveling car increases in speed, the speed signal on lead 23 increases to correspondingly decrease the error signal at 25 which gradually rotates the cam surface 30 in a counter-clockwise direction. Such decreasing error signal thus gradually lowers the control element 31 and the venting of fluid through the control port 73 is gradually decreased to correspondingly increase the pressure within control chamber 61. Thus, as the vehicle speed increases in a downward direction, the control piston 57 gradually descends to gradually close the poppet valve 36 and decrease the fluid flow from the hydraulic actuator 4.

When the downward speed reaches the commanded speed on lead 21, the error signal at 25 goes to zero and the poppet valve 36 is held at a desired open position for maintaining the desired velocity for car 2. The downward traveling velocity of the system is self-regulating and variances in speed are reflected in the error signal which appropriately positions the cam surface 30 and hence the control element 31 to appropriately control the opening of the poppet valve 36.

When it is desired to stop a downwardly traveling car, the commanded velocity signal on lead 21 is decreased to zero so that the vehicle velocity signal on lead 23 dominates the error signal to rotate the cam surface 30 in a counter-clockwise direction. The resulting downward movement of the control element 31 decreases the pressure within chamber portion 62 and requires the piston 57 to travel downwardly to a position permitting the poppet valve 36 to close and hold the car stationary.

The response of the system can be readily adjusted by varying the needle valves 66 and 67 and regulating the rate at which pressure changes are permitted to occur within the chamber portions 61 and 62. The manual pre-selected setting of needle valve 66 establishes a predetermined maximum acceleration limitation for downward movement by limiting the rate of pressure change within chamber portion 61. Such pressure rate limitation correspondingly limits the rate of opening movement of the poppet valve 36. The manual pre-selected setting of the needle valve 67 likewise establishes a predetermined maximum acceleration limitation for upward movement by limiting the rate of pressure change within the chamber portion 62 and thus the rate of closing movement of the by-pass valve 53.

While the pump 12 is described as a constant displacement type, a variable displacement type pump could also be employed with the invention to provide an added control feature if desired.

While the supervisory control 18 is only partially illustrated for brevity and could constitute a manual control, it should be understood that a completely automated supervisory control may be desirable which senses car and hall calls to automatically provide a plurality of control signals for operating the system including the provision of the pump start signal on lead 19 and the commanded velocity signal on lead 21. It is further noted that the commanded velocity signal on lead 21 could be a constant magnitude signal or a velocity pattern signal which continuously varies. Such a continuously varying speed command signal could also provide pre-selected or predetermined velocity, acceleration and rate of change of acceleration limitations for generating a highly desirable error signal. While the control and regulating circuit 24 is shown in block form as a pulse source coupled through a logic circuit to selectively supply forward and reverse pulses to the stepper motor 27, it is understood that other circuit arrangements could also be provided for responding to the error signal and operating the control element 31.

The invention thus provides a highly desirable hydraulic elevator drive system which is accurately controlled to provide riding comfort and efficient elevator service.

Various modes of carrying out the invention are contemplated as being within the scope of the following claims particularly pointing out and distinctly claiming the subject matter which is regarded at the invention.

I claim:

1. A hydraulic elevator drive system wherein a fluid pump is operatively connected through fluid control means to a hydraulic actuator operatively controlling the movement of an elevator car, wherein said fluid control means comprises a control structure providing chamber means having a first port operatively connected to said hydraulic actuator and a second port operatively venting fluid from said chamber means and a third port operatively connected to said fluid pump, first valve means operable between open and closed positions and controlling the fluid flow through said first port, second valve means operable between open and closed positions and controlling the fluid flow through said second port, and common valve operator means operatively connected to said first and second valve means and selectively operable between a first condition opening said second valve and a second condition closing said second valve and a third condition opening said first and second valves and selectively controlling the movement of said car.

2. The elevator drive system of claim 1, wherein said fluid control means includes third valve means operable between open and closed positions and controlling the fluid flow through said third port.

3. The elevator drive system of claim 2, wherein said fluid control means includes means operably actuating said pump and supplying fluid to said control structure and opening said third valve means, and means operatively actuating said common valve operator means sequentially from said first condition to said second condition and operatively moving said car in an upward direction.

4. The elevator drive system of claim 3, wherein said actuating means includes means providing a car movement command signal, means sensing the movement of said car and providing a movement responsive signal, and means responding to said command and movement signals and providing an error signal operatively actuating said common valve operator means.

5. The elevator drive system of claim 2, wherein said fluid control means includes means operatively actuating said pump from a first condition supplying fluid to said third port to a second condition operatively closing said third valve means and stopping said car.

6. The elevator drive system of claim 5, wherein said fluid control means includes means operatively actuating said common valve operator means to said third condition and operatively moving said car in a downward direction.

7. The elevator drive system of claim 6, wherein said actuating means includes means providing a car movement command signal, means sensing movement of said car and providing a movement responsive signal, and means responding to said command and movement signals and providing an error signal operatively actuating said common valve operator means.

8. A hydraulic elevator drive system wherein fluid control means regulates the fluid within a hydraulic actuator operatively controlling the movement of an elevator car, wherein said fluid control means comprises means including first and second valve means selectively operable by a control member having a first position operatively maintaining fluid within said hydraulic actuator and a second position operatively venting fluid from said hydraulic actuator by the simultaneous opening of said first and second valve means.

9. The elevator drive system of claim 8, and including a fluid pump operatively connected to said fluid control means, and said control member having a third position permitting fluid flow from said pump to said hydraulic actuator.

10. The elevator drive system of claim 9, wherein said fluid control means includes means selectively operating said pump and supplying fluid to said fluid control means, said first position provided by said control member operatively venting the fluid supplied by said pump.

11. The elevator drive system of claim 8, wherein said fluid control means includes first means including a fluid pressure chamber providing a first control force upon said control member and second means providing a second control force upon said control member and means selectively controlling the fluid pressure within said pressure chamber and selectively positioning said control member.

12. The elevator drive system of claim 11, wherein said pressure controlling means includes vent means operatively venting fluid from said pressure chamber.

13. The elevator drive system of claim 12, wherein said pressure controlling means includes means variably venting fluid from said pressure chamber and providing variable movement to said control member.

14. The elevator drive system of claim 13, wherein said fluid control means includes means providing a movement command signal, means responsive to the operation of said car and providing an operational responsive signal, and means responding to said command and operational signals and providing an error signal, said variable venting means operating in response to said error signal.

15. The elevator drive system of claim 11, wherein said pressure controlling means includes selectively variable input means operatively controlling the rate of fluid flow to said pressure chamber and selectively providing an acceleration limitation to said car.

16. The elevator drive system of claim 11, wherein said second means includes a second fluid pressure chamber providing said second control force upon said control member, and said controlling means selectively controlling the fluid pressure within said first and second pressure chambers and selectively positioning said control member.

17. The elevator drive system of claim 16, and including a pump operatively connected to said fluid control means, and said control member providing a third position permitting fluid flow from said pump to said hydraulic actuator, said pressure controlling means including vent means operatively venting fluid from said first pressure chamber and establishing said second position and operatively venting fluid from said second pressure chamber and establishing said third position.

18. The elevator drive system of claim 17, wherein said pressure controlling means includes means variably venting fluid from said first and second pressure chambers and providing variable movement to said control member.

19. The elevator drive system of claim 18, wherein said fluid control means includes means providing a movement command signal, means responsive to the operation of said car and providing an operational responsive signal, and means responding to said command and operational signals and providing an error signal, said variable venting means operating in response to said error signal.

20. The elevator drive system of claim 16, wherein said pressure controlling means includes selectively variable input means operatively controlling the rate of fluid flow to said first and second pressure chambers and providing an acceleration limitation to said car.

21. The elevator drive system of claim 20, wherein said input means includes first and second valves independently selectively adjustable and establishing first and second acceleration limitations, respectively.

22. A hydraulic elevator drive system wherein a fluid pump is operatively connected through fluid control means to a hydraulic actuator operatively controlling the movement of an elevator car, wherein said fluid control means comprises means providing an electrical speed command signal, means sensing the speed of said car and providing an electrical velocity signal, means responding to said command and velocity signals and providing an electrical error signal, and means responding to said electrical error signal and controlling the passage of fluid to said hydraulic actuator.

23. The elevator drive system of claim 22, wherein said error responding means provides a first condition permitting fluid to be retained by said hydraulic actuator and a second condition permitting fluid flow from said pump to said hydraulic actuator in response to said error signal.

24. The elevator drive system of claim 23, wherein said error responding means provides a third condition permitting the venting of fluid from said hydraulic actuator.

25. The elevator drive system of claim 22, wherein said error responding means includes means operatively varying the fluid flow from said pump to said hydraulic actuator in response to said electrical error signal.

26. The elevator drive system of claim 22, wherein said responding means includes means operatively providing an acceleration limitation upon said car.

27. A hydraulic elevator drive system wherein fluid control means regulates the fluid within a hydraulic actuator operatively controlling the movement of an elevator car, wherein said fluid control means comprises means providing an electrical speed command signal, means sensing the speed of said car and providing an electrical velocity signal, means responding to said command and velocity signals and providing an electrical error signal, and means responding to said electrical error signal and controlling the passage of fluid from said hydraulic actuator.

28. The elevator drive system of claim 27, wherein said error responding means provides a first condition permitting fluid to be retained by said hydraulic actuator and a second condition permitting the venting of fluid from said hydraulic actuator.

29. The elevator drive system of claim 27, wherein said error responding means includes means operatively varying the venting of fluid flow from said hydraulic actuator in response to said error signal.

30. The elevator drive system of claim 27, wherein said error responding means includes means operatively providing an acceleration limitation upon said car.

31. A hydraulic elevator drive system wherein a fluid storage tank and a fluid pump are operatively connected through a fluid control to a hydraulic actuator operatively controlling the movement of an elevator car, wherein said fluid control comprises a control structure providing a first chamber having a first port operatively connected to said hydraulic actuator and a second chamber having a second port operatively connected to said pump and a third chamber having a third port operatively connected to said storage tank, a first valve normally biased to close said second port and selectively operable in response to the operation of said pump to permit fluid flow through said second port into said second chamber, a second valve normally biased to close an opening between said first and second chambers and selectively operable in response to an increase in pressure within said second chambers to permit fluid flow between said first and second chambers, a third valve selectively operable between an open position and a closed position to close an opening between said second and third chambers, a valve operator connected to selectively operate said second and third valves between said open and closed positions and including a piston connected through a valve stem to said third valve and selectively movably within a piston chamber including a first chamber portion adjacent a first side of said piston and communicating through a first passageway with said first chamber and a second chamber portion adjacent a second side of said piston and communicating through a second passageway with said first chamber, said valve stem including a control chamber having a first control port communicating with said first chamber portion and a second control port communicating with said second chamber portion and a third control port communicating with said third chamber, and a control element movably disposed within said control chamber and including a control channel having a first end operatively communicating with said third chamber and a second end selectively communicating with said first and second control ports, said control element movable to a first position and closing said first and second control ports and maintaining said valve stem at a first position maintaining said third valve open and said second valve closed to hold said car stationary, said control element movable to a second position and closing said first control port and communicating said second control port with said second end of said control channel and operatively moving said valve stem to a second position closing said third valve so that operation of said pump operatively opens said first and second valves to move said car in an upward direction, said control element movable to a third position and closing said second control port and communicating with said first control port with said second end of said control channel and operatively moving said valve stem to a third position opening said second and third valves to move said car in a downward direction.

32. The hydraulic elevator drive system of claim 31, wherein said fluid control includes a sensor operatively connected to said car and providing a first electrical signal proportional to the velocity of said car, an electrical control selectively providing a second electrical signal proportional to the desired velocity of said car, a comparison circuit operatively receiving said first and second signals and providing an error signal varying in accordance with the difference between said first and second signals, and an electrical motor having an eccentric cam output connected to variably position said control element between said first, second and third positions in response to said error signal.

* * * * *

UNITED STATES PATENT AND TRADEMARK OFFICE

CERTIFICATE OF CORRECTION

PATENT NO. : 3,977,497

DATED : August 31, 1976

INVENTOR(S) : David C. McMurray

It is certified that error appears in the above-identified patent and that said Letters Patent are hereby corrected as shown below:

| | | |
|---|---|---|
| ABSTRACT, | Line 11, | Cancel "whle" and substitute therefor ---while---; |
| ABSTRACT, | Line 12, | Cancel "valve" and substitute therefor ---valves---; |
| Column 4, | Line 27, | After "at" insert ---a---; |
| Column 7, | Line 40, | Cancel "at" and substitute therefor ---the---; |
| Column 8, | Line 14, | Cancel "Becu-" and substitute therefor ---Beca----; |
| Column 8, | Line 15, | Cancel "ase" and substitute therefor ---use---; |
| Column 9, | Line 10, | Cancel "inparted" and substitute therefor ---imparted---; |
| Column 9, | Line 26, | Cancel "s" and substitute therefor ---a---; |
| Column 9, | Line 54, | Cancel "rapdily" and substitute therefor ---rapidly---; |

UNITED STATES PATENT AND TRADEMARK OFFICE

CERTIFICATE OF CORRECTION

PATENT NO. : 3,977,497

DATED : August 31, 1976

INVENTOR(S) : David C. McMurray

It is certified that error appears in the above-identified patent and that said Letters Patent are hereby corrected as shown below:

Column 11, Line 6, Cancel "at" and substitute therefor ---as---.

Signed and Sealed this

Fifteenth Day of February 1977

[SEAL]

*Attest:*

RUTH C. MASON
*Attesting Officer*

C. MARSHALL DANN
*Commissioner of Patents and Trademarks*